US005708924A

United States Patent [19]

Shogren et al.

[11] Patent Number: 5,708,924

[45] Date of Patent: Jan. 13, 1998

[54] CUSTOMER REPLACEABLE PHOTORECEPTOR BELT MODULE

[75] Inventors: David K. Shogren, Ontario; Larry L. Jenkins, Fairport, both of N.Y.

[73] Assignee: Xerox Corporation, Stamford, Conn.

[21] Appl. No.: 724,587

[22] Filed: Sep. 30, 1996

[51] Int. Cl.[6] ..... G03G 21/00; B65D 85/02

[52] U.S. Cl. ..... 399/116; 399/117; 399/164; 206/303; 206/493

[58] Field of Search ..... 399/116, 117, 399/164; 206/320, 303, 493, 449

[56] References Cited

U.S. PATENT DOCUMENTS

| | | | |
|---|---|---|---|
| 3,888,577 | 6/1975 | Meyer | 399/116 |
| 4,470,690 | 9/1984 | Hoffman et al. | 399/164 |
| 4,563,077 | 1/1986 | Komada | 399/165 |
| 4,616,920 | 10/1986 | Itoigawa | 399/116 |
| 4,626,095 | 12/1986 | Berger | 399/165 |
| 4,657,369 | 4/1987 | Takeuchi | 399/116 X |
| 4,766,455 | 8/1988 | Carter | 399/116 |
| 4,811,839 | 3/1989 | Cornell et al. | 206/303 |
| 5,243,384 | 9/1993 | Everdyke | 399/116 |
| 5,400,121 | 3/1995 | Foote | 399/116 |
| 5,417,322 | 5/1995 | Jeran et al. | 206/303 |

*Primary Examiner*—Nestor R. Ramirez
*Attorney, Agent, or Firm*—William A. Henry, II

[57] ABSTRACT

A customer replaceable unit includes a cover and support structure for supporting a photoreceptor belt while it is packaged, shipped and inserted over drive and idler rolls in a machine. It prevents a machine operator from having to handle the belt itself and provides protection from extrinsic damage.

8 Claims, 4 Drawing Sheets

CUSTOMER REPLACEABLE PHOTORECEPTOR BELT MODULE

BACKGROUND OF THE INVENTION

The present invention relates generally to an electrophotographic printing machine, and more particularly, concerns a replaceable module adapted to use therein.

Generally, the process of electrostatographic copying is initiated by exposing a light image of an original document onto a substantially uniformly charged photoreceptive member. Exposing the charged photoreceptive member to a light image discharges a photoconductive surface thereon in areas corresponding to non-image areas in the original document while maintaining the charge in image areas, thereby creating an electrostatic latent image of the original document on the photoreceptive member. This latent image is subsequently developed into a visible image by depositing charged developing material onto the photoreceptive member such that the developing material is attracted to the charged image areas on the photoconductive surface. Thereafter, the developing material is transferred from the photoreceptive member to a copy sheet or to some other image support substrate, to create an image which may be permanently affixed to the image support substrate, thereby providing an electrophotographic reproduction of the original document. In a final step in the process, the photoconductive surface of the photoreceptive member is cleaned to remove any residual developing material which may be remaining on the surface thereof in preparation for successive imaging cycles. The electrostatographic copying process described hereinabove is well known and is commonly used for light lens copying of an original document. Analogous processes also exist in other electrostatographic printing applications such as, for example, digital laser printing where a latent image is formed on the photoconductive surface via a modulated laser beam, or ionographic printing and reproduction where charge is deposited on a charge retentive surface in response to electronically generated or stored images. One of the drawbacks to customer replaceable photoreceptor belt modules is having the customer handle the belt itself and extrinsic damage sustained by the photoreceptor. A need has been shown for an improved and inexpensive apparatus and method for supporting a photoreceptive or photoconductive belt while it is packaged, shipped and inserted over drive and idler rolls in a machine.

PRIOR ART

Various types of replaceable photoconductive belt units have hereinbefore been used as illustrated by the following disclosures, which may be relevant to certain aspects of the present invention:

U.S. Pat. No. : 4,470,690 Patentee: Hoffman Issued: Sep. 11, 1984

U.S. Pat. No. : 4,563,077 Patentee: Komada Issued: Jan. 7, 1986

U.S. Pat. No. : 4,616,920 Patentee: Itoigawa et al. Issued: Oct. 14, 1986

U.S. Pat. No. : 4,626,095 Patentee: Berger Issued: Dec. 2, 1986

U.S. Pat. No. : 4,657,369 Patentee: Takeuchi Issued: Apr. 14, 1987

U.S. Pat. No. : 5,243,384 Patentee: Everdyke et al. Issued: Sept. 7, 1993

The relevant portions of the foregoing patents may be briefly summarized as follow:

U.S. Pat. No. 4,470,690 discloses a removably mounted electrophotographic belt assembly for an electrostatic copier. The belt assembly is a self-contained unit having side plates and a pair of rollers about which the belt is entrained.

U.S. Pat. No. 4,563,077 describes a removable belt module mechanism for an image recording apparatus. The belt module has a drive roller, an idler roller, a tension roller and a photoreceptor belt. The tension roller is actuated by a spring. A set of guides are provided to guide the belt module into the recording apparatus.

U.S. Pat. No. 4,616,920 discloses a copying machine having a belt module. The belt module has an endless photoreceptor belt, two rollers and a lid. The lid covers the belt and protects it from light exposure. A tension lever adjusts the distance between two rollers to regulate the tension on the photoreceptor belt.

U.S. Pat. No. 4,626,095 describes a photoreceptor belt holder drawer for a copier. The drawer has two cylinders. One of the cylinders is mounted movably to adjust the tension of the belt.

U.S. Pat. No. 4,657,369 discloses a disposable photoconductive belt assembly. The belt assembly has a photoconductive belt, two rollers, a charging unit, and a means for detachably mounting the assembly in a printer or a copier. A photosensor is also included with the assembly to assist tin locating the belt seam. Several guides are provided to guide and mount the belt assembly vertically in the printer or copier. A handle is provided to aid in removal of the assembly. Belt tension is a factory set.

U.S. Pat. No. 5,243,384 is directed to a module adapted to be mounted removably in a printing machine. The module has a photoconductive belt entrained about a plurality of rollers mounted on a frame. One of the rollers is movable between a non-operative position, in which the space between the rollers is reduced, and an operative position, in which the space between the rollers is increased. A charging station and a cleaning station are mounted on a frame of the module adjacent the photoconductive belt. When one of the rollers is in the non-operative position, a cover covers at least the photoconductive belt. The cover has an insert about which a portion of the photoconductive is wrapped. The insert supports the photoconductive belt in a non-tensioned condition external to the printing machine.

SUMMARY OF THE INVENTION

Accordingly, pursuant to the features of the present invention, a customer replaceable unit (CRU) is provided that includes an inexpensive means of supporting a photoreceptor belt while it is packaged, shipped and inserted over drive and idler roll in a machine. The CRU includes an infrastructure for supporting the photoreceptor belt during shipment and in use in a xerographic machine.

BRIEF DESCRIPTION OF THE DRAWINGS

The foregoing and other features of the instant invention will be apparent from a further reading of the specification, claims and from the drawings in which:

All references cited in this specification, and their references, are incorporated by reference herein where appropriate for teaching additional or alternative details, features, and/or technical background.

While the present invention will be described hereinafter in connection with a preferred embodiment thereof, it should be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 3A:
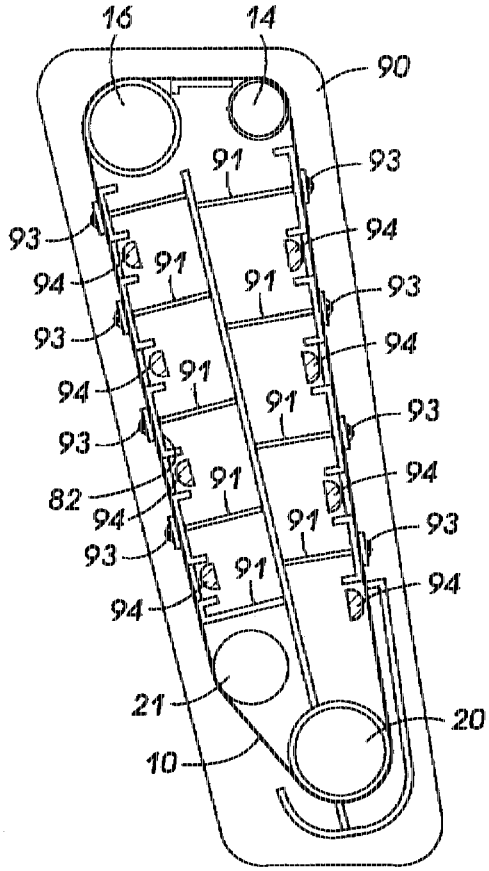
FIG. 3A illustrates a photoreceptor in a retracted, load position.
Figure 3B:
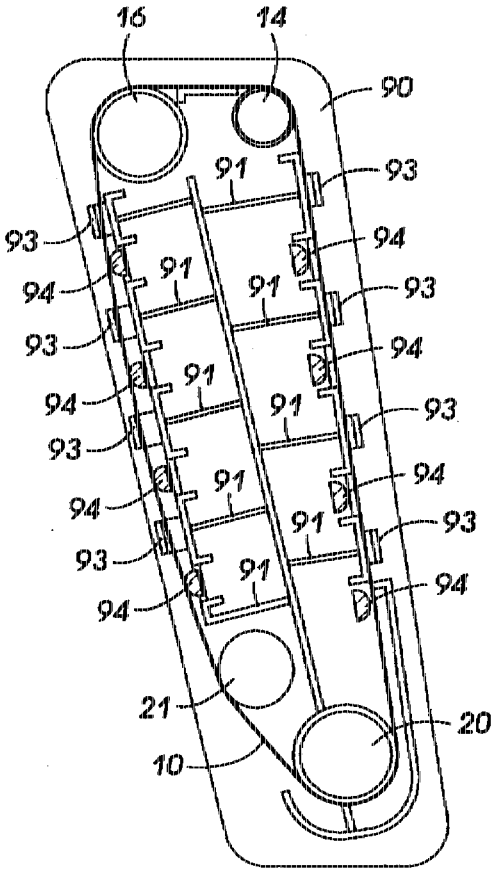
FIG. 3B illustrates the photoreceptor in FIG. 3A in an expanded, run position.
Figure 4:
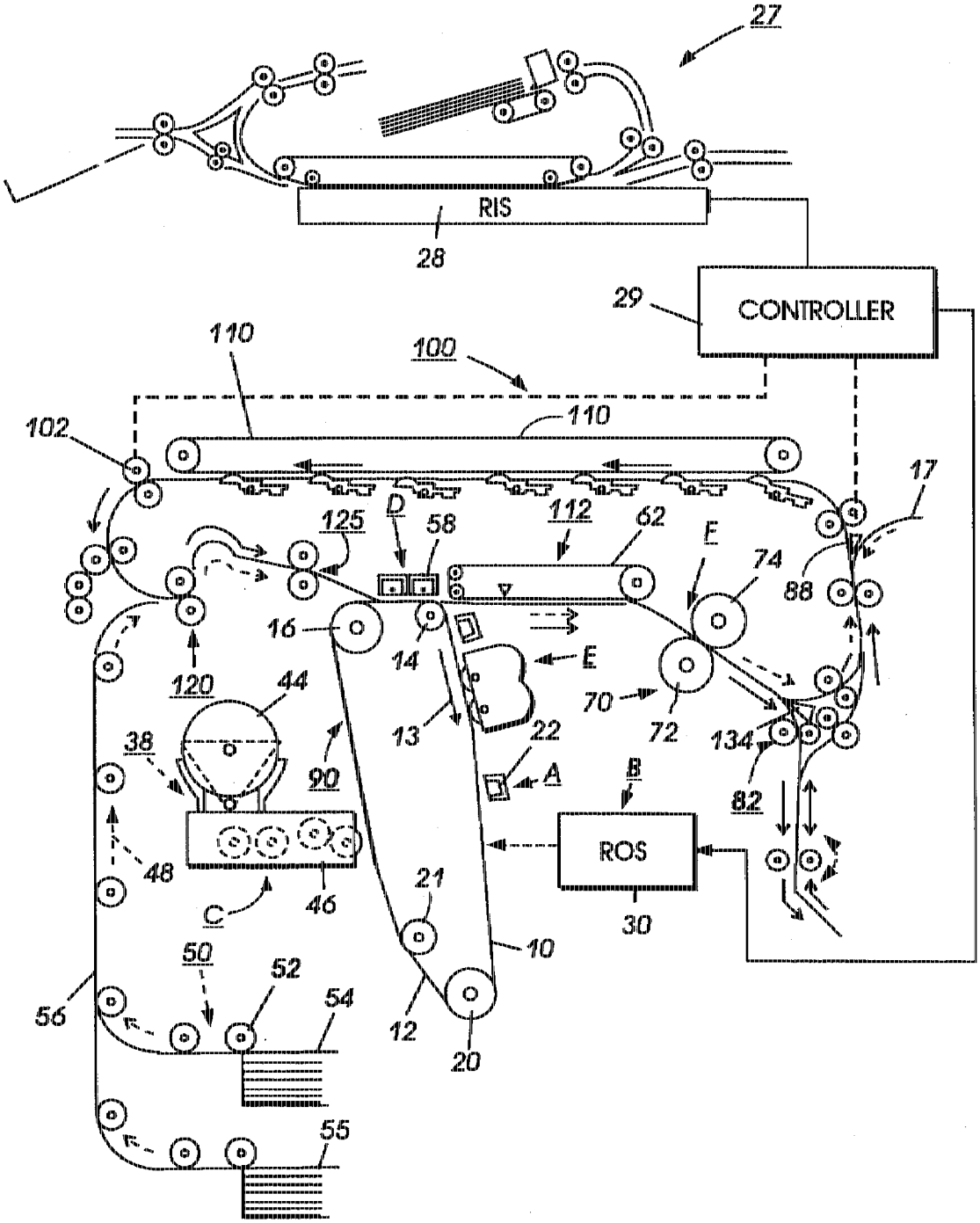
FIG. 4 is a schematic elevational view depicting the belt module of the present invention in a printing machine.

Referring now to the subject matter of the present invention, FIGS. 1, 2, 3A, and 3B depict the customer replaceable unit (CRU) of the present invention, indicated generally by reference numeral 80. The CRU 80 provides an inexpensive means of supporting a photoreceptor belt while it is packaged, shipped and inserted over drive and idler rolls in a machine, such as shown in FIG. 4. CRU 80 makes it unnecessary for a machine operator to handle the belt itself when belt changing is required and it also protects the photoreceptor belt from damage due to extraneous events. The CRU module 80 comprises a fight plastic frame 82 that fits inside photoreceptor belt 10 and holds belt 10 in near its final shape such that the belt can slip over drive roll 16, tensioning roll 20, idler roll 21, and stripper roll 14 of a photoreceptor module. Frame 82 slides into tracks 91 of photoreceptor module 90 when CRU 80 is inserted into the printer of FIG. 4 and holds belt 10 in position until it is located over drive roll 16, tensioning roll 20, idler roll 21, and stripper roll 14. At this point, photoreceptor module backer bars 94, which had previously been in a retracted position as shown in FIG. 3A, are released and, at the same time hold down springs 93 which were in a retracted position to help hold belt 10 in place during insertion into the photoreceptor module are released allowing photoreceptor belt 10 to be expanded to the final shape as shown in FIG. 3B. To complete the belt loading process, tension roll 20 lowered from a retracted position to place proper tension onto the belt.

To remove the CRU 80 and belt 10 from the printer of FIG. 4, the insertion process is reversed. That is, tension roll 16 is retracted away from photoreceptor belt 10, backer bars 94 and hold down springs 93 are set and then CRU 80 is withdrawn from the photoreceptor module 90.

Figure 1:
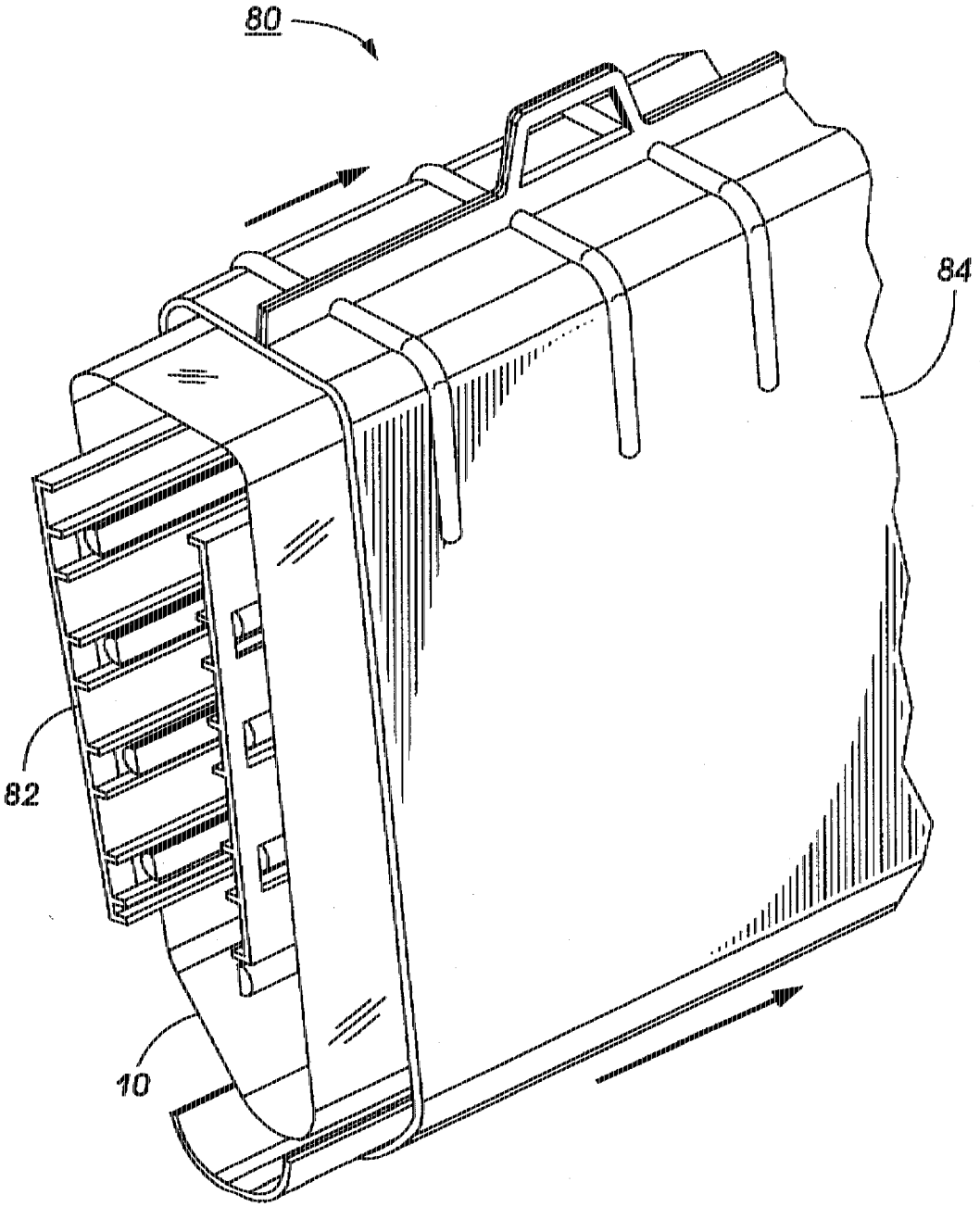
FIG. 1 illustrates a partial protective covering with an end cover removed and support structure for a photoreceptor belt used for packaging and shipping the photoreceptor belt in accordance with the present invention.
Figure 2:
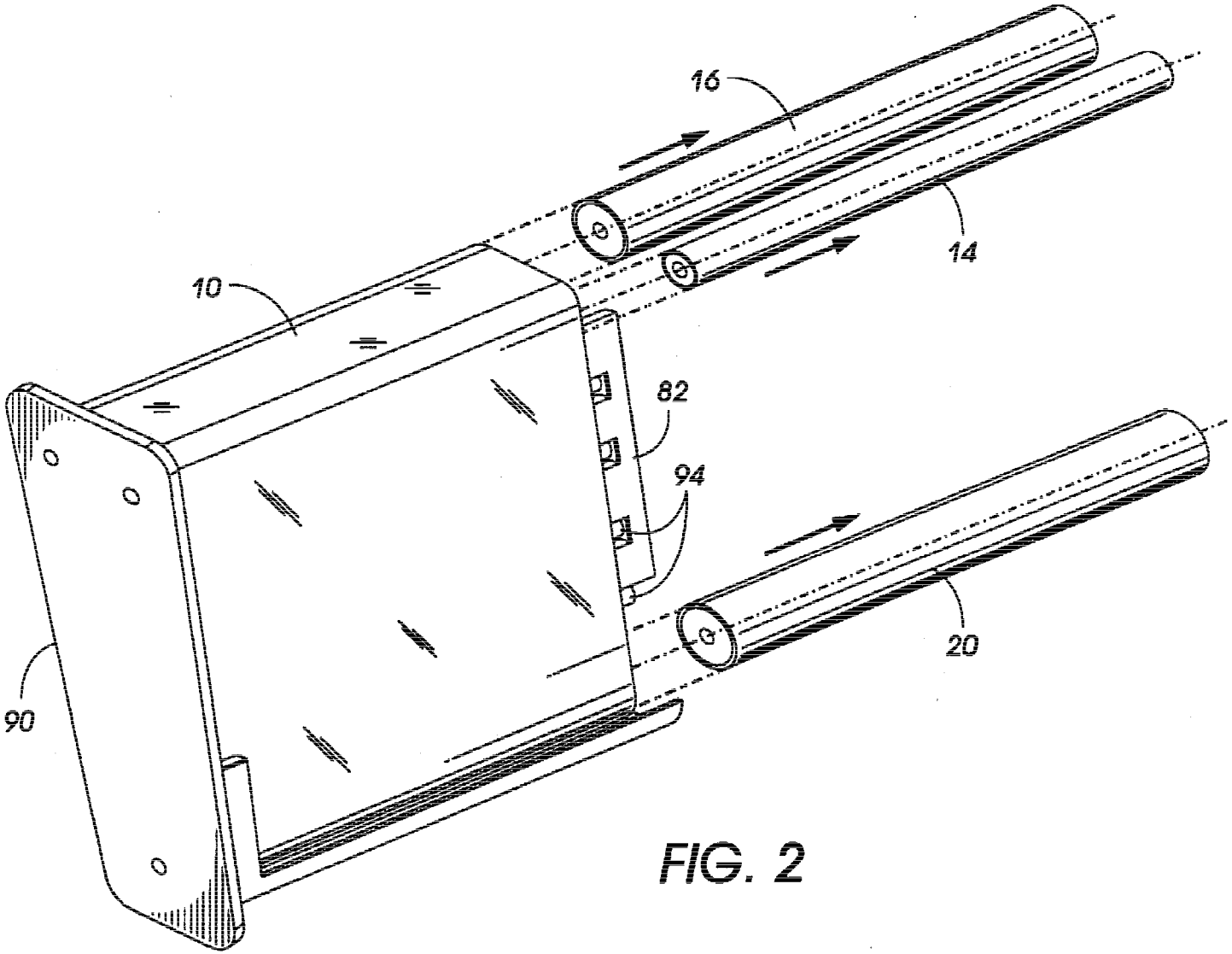
FIG. 2 illustrates a photoreceptor belt mounted in a photoreceptor module with shipping support structure positioned within the photoreceptor module as well.

As shown in FIG. 1, CRU 80 includes a disposable circumferential cover 84 that is placed over belt support 82 and photoreceptor belt 10 to protect the belt while being shipped and handled. To load the covered photoreceptor into the machine of FIG. 4, the inside end cover is removed. Frame member 82 of CRU 80 is then inserted into tracks 91 of photoreceptor module 90. As the CRU becomes self supporting, the circumferential cover 84 snaps apart and falls away leaving the belt free to be inserted further into a final position within photoreceptor module 90.

FIG. 4 schematically depicts an electrophotographic printing machine incorporating the features of the present invention therein. It will become evident from the following discussion that the customer replaceable unit of the present invention may be employed in a wide variety of devices and is not specifically limited in its application to the particular embodiment depicted herein. Referring to FIG. 4 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 4 schematically illustrates an electrophotographic printing machine which generally employs a photoconductive belt 10 mounted a belt support module 90. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roll 14, tensioning roll 16, idler roll 21, and drive roll 20. As roll 20 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. Preferably, a nine facet polygon is used. The ROS illuminates the charged portion of photoconductive belt 10 at a resolution of about 300 or more pixels per inch. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material A toner particle dispenser, indicated generally by the reference numeral 44, dispenses toner particles into developer housing 46 of developer unit 38.

With continued reference to FIG. 4, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a feed roll 52 contacting the uppermost sheet of stack 54. Feed roll 52 rotates to advance the uppermost sheet from stack 54 into vertical transport 56. Vertical transport 56 directs the advancing sheet 48 of support material into registration transport 57 past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 17 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 85 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 17.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with fight to dissipate any residual electrostatic charge remaining thereon prior to the charging thereof for the next successive imaging cycle The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

It should now be understood that an inexpensive apparatus and method has been shown that is directed toward supporting a photoreceptor belt while it is packaged, shipped and inserted over drive and idler rolls in a machine, the apparatus relieves the customer from having to handle the photoreceptor belt itself and provides protection for the photoreceptor belt from intrinsic damage.

While the invention has been described with reference to the structure herein disclosed, it is not confined to the details as set forth and is intended to cover any modifications and changes that may come within the scope of the following claims.

What is claimed is:

1. An arrangement for ease in installing a belt into and removing the belt from a printing machine, comprising;

a belt support module stationarily positioned within the printing machine and adapted to support a belt thereon, said belt support module including a belt support structure, a drive roll, a retractable belt tensioning roll, a stripping roll and an idler roll, track members, backer bars movable between retracted and non-retracted positions, and hold down springs movable between retracted and non-retracted positions; and a customer replaceable unit adapted to be mounted onto said belt support module within the printer, said customer replaceable unit including a belt, and a frame configured in the approximate shape of said belt once said belt is in position within the printing machine, and wherein said frame includes guide members that mate with said track members of said belt support module during insertion of said customer replaceable unit into the printer.

2. The arrangement of claim 1, wherein said belt is photosensitive.

3. The arrangement of claim 2, wherein said tensioning roll is in a retracted position when said customer replaceable unit is inserted into the printer.

4. The arrangement of claim 3, wherein backer bars are in a retracted position when said customer replaceable unit is inserted into the printer.

5. The arrangement of claim 4, wherein during insertion of said customer replaceable unit onto said belt module said frame holds said photosensitive belt in position until it is located over said drive, tensioning, stripping and idler rolls of said belt module.

6. The arrangement of claim 5, wherein said tensioning roll is moved into a non-retracted position once said customer replaceable unit is installed within the printer.

7. The arrangement of claim 6, wherein said backer bars and said hold down springs are in said non-retracted position while said customer replaceable unit is being removed from said belt module.

8. The arrangement of claim 7, including a cover member adapted to cover said photosensitive belt during packaging, shipping, and insertion onto said belt module of the printer, said cover member comprising two articulatable sides and a removable end portion, said end portion being adapted for removal in order for said customer replaceable unit to be positioned onto said photoreceptor belt support module.

* * * * *